United States Patent [19]

Stephens

[11] 4,027,706

[45] June 7, 1977

[54] LIQUID DISPENSING AND VAPOR RECOVERY SYSTEM

[75] Inventor: James R. Stephens, Bartlesville, Okla.

[73] Assignee: Phillips Petroleum Company, Bartlesville, Okla.

[22] Filed: Nov. 13, 1975

[21] Appl. No.: 631,581

[52] U.S. Cl. ..... 141/301; 141/347

[51] Int. Cl.[2] ..... B65B 3/18

[58] Field of Search ..... 141/59, 269, 285, 290, 141/291, 301, 302, 311, 346, 347, 372, 383, 385, 392

[56] References Cited

UNITED STATES PATENTS

| | | | |
|---|---|---|---|
| 138,421 | 4/1873 | Matthews | 141/302 |
| 2,175,303 | 10/1939 | Muller | 141/347 X |
| 2,175,304 | 10/1939 | Muller | 141/290 X |

*Primary Examiner*—Richard E. Aegerter
*Assistant Examiner*—Frederick R. Schmidt

[57] ABSTRACT

An apparatus for dispensing liquids into a container or tank with the container or tank having a filling hatch. The apparatus includes a filling tube which has a flange secured thereto which carries a seal member adapted to engage portions of the hatch for forming a seal between the flange and the hatch. Dispensing apertures are provided adjacent a lower end of the filling tube and a valve member is slidably mounted on the filling tube and is moveable between an aperture open and an aperture closed position with seal means being provided that cooperate with the filling tube and the valve member to prevent leakage of fluid from the filling tube when the valve member is in the aperture closed position. Means are provided to effect movement of the tubular member and a linkage arrangement is also provided whereby movement of the valve member to the aperture open position, moves a portion of the linkage arrangement into engagement with an inside portion of the tank or hatch to releaseably retain the apparatus in a filling position in the tank and the flange in sealing engagement with the hatch. A vapor exhaust communicates from the exterior to the interior of the tank when the apparatus is in a filling position in the tank and provides an exhaust for vapor which will be discharged from the tank during filling of same so that the vapor can be collected rather than discharged into the atmosphere.

7 Claims, 2 Drawing Figures

LIQUID DISPENSING AND VAPOR RECOVERY SYSTEM

In the past, tanks, particularly transport truck tanks used in hauling gasoline or other hydrocarbon materials, were loaded by inserting a fillpipe through an open hatch into the interior of the tank. As the tank was filled, a mixture of air and vapors from the filling liquid were exhausted to the atmosphere. Current environmental regulations and laws prohibit the escape of such vapors into the atmosphere and require that the vapors be collected and not discharged into the atmosphere to reduce air pollution and also to prevent explosion hazards. There are currently available liquid dispensing means that are operable for preventing escape of vapor into the atmosphere. Certain problems have been attendant with the dispensing means known to date, one major problem being the requirement of excessive force applied to the tank to maintain the sealing relation between the dispensing means and the hatch. This is normally accomplished by a downward force on the dispensing means to maintain the sealing engagement with the hatch with this load also being transmitted to and carried by the entirety of the tank. Another problem is that the dispensing means must be capable of accommodating slightly different size and shape hatches so as to prevent leakage of vapor to the atmosphere. A third problem, of environmental concern, is that after filling when the dispensing means is removed from the tank, a certain amount of residual liquid which remains in the dispensing nozzle would drain out onto the ground or loading facility with the liquid subsequently evaporating, releasing vapors to the atmosphere.

The principal objects and advantages of the present invention are: to provide an apparatus useful for filling containers or the like which overcomes the above-mentioned difficulties; to provide such an apparatus which is compact and lightweight facilitating the use thereof; to provide such an apparatus which can be easily used by an operator; to provide such an apparatus which provides positive sealing between the hatch and the apparatus to prevent escape of vapor into the atmosphere while not requiring excessive downward force to be applied to the tank; and to provide such an apparatus which is well adapted for its intended use, simple in construction and economical to manufacture and maintain.

Other objects and advantages of the present invention will become apparent from the following description taken in connection with the accompanying drawings wherein are set forth by way of illustration and example certain embodiments of the present invention.

Figure 1:
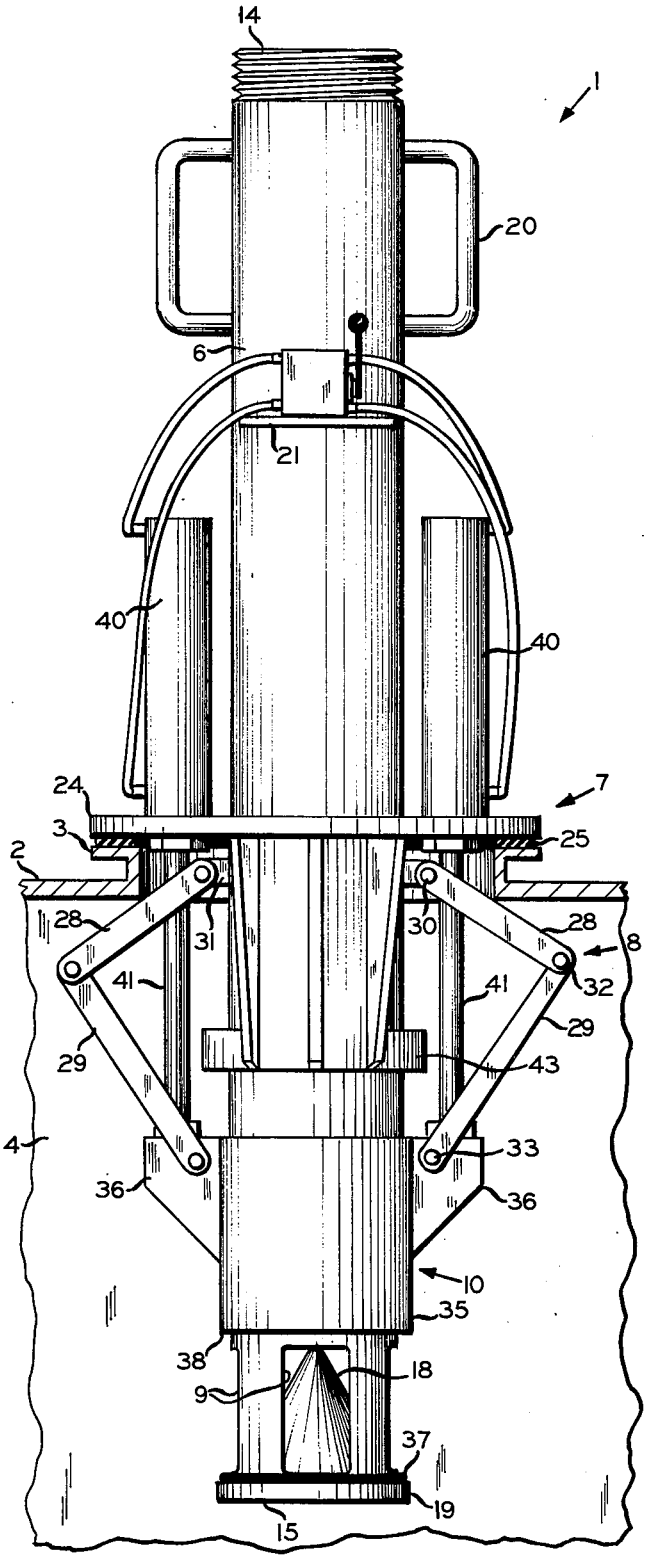
FIG. 1 is a side-elevation view of a liquid dispensing apparatus shown in filling position on a transport truck.

Referring more in detail to the drawings:

As required, detailed embodiments of the present invention are disclosed herein, however, it is to be understood that the disclosed embodiments are merely exemplary of the invention which may be embodied in various forms. Therefore, specific structural and fucntional details disclosed herein are not to be interpreted as limiting but merely as a basis for the claims and as a representative basis for teaching one skilled in the art to variously employ the present invention in virtually any appropriate detailed structure.

The reference numeral 1 designates generally an apparatus for dispensing a fluid into a container or tank 2 or the like. The container 2 has a hatch 3 which defines a filling opening for the container 2 whereby fluid can be dispensed into the interior 4 of the container. The apparatus 1 includes a filling tube 6 which cooperates with means 7 adapted for sealingly engaging portions of the hatch 3. Retaining means 8 are provided for releaseably retaining the apparatus 1 in sealing engagement with the hatch 3. Discharge apertures 9 are provided for the dispensing of fluid into the container 2 and means 10 is provided for selectively opening and closing the apertures 9. Conduit-forming means 11 communicate between the interior and the exterior of the container 2 when the apparatus 1 is in a filling position to provide a flow passage for the escape of vapors expelled from the container 2.

As shown, the filling tube 6 is elongate and has opposite ends 14 and 15 and has a flow passage 16 therebetween. The end 14 is suitable for connection to a discharge conduit (not shown) as by having a threaded portion 17. Preferably, the end 15 is closed as by having a cone-shaped closure member 18 suitably secured within the interior of the tube 6 by suitable means, such as welding. As shown, the cone diverges in a downstream direction and helps aid in fluid discharge through the discharge apertures 9. Preferably, the end 15 has a flange 19 extending radially outward from the tube 6 for a purpose to be later described. To facilitate handling of the apparatus 1 by an operator, handles 20 are secured to the filling tube 6 adjacent the end 14. Also, a bracket 21 can be secured to the filling tube 6 for the mounting of various control devices to be later described.

In the illustrated structure, the means 7 includes a flange 24 which is secured to the filling tube 6 and extends radially outwardly therefrom at a position between the ends 14 and 15. A seal 25, such as a gasket or other suitable type of seal member, is carried by the flange 24 as by securement in a groove 26 or by any other suitable method and is adapted to engage a portion of the hatch 3. The flange 24 is sized and shaped to rest upon an upper portion of the hatch 3 for sealing engagement with same to prevent the escape of vapor from the container 2 by flow between the flange 24 and hatch 3.

Retaining means 8 are carried by the filling tube 6 and are adapted to releaseably retain the apparatus 1 in filling relation to the container 2. The retaining means 8 are so constructed as to fit within the hatch 3 and be positioned within the container 2 when the apparatus 1 is in its filling position. As shown, a plurality of linkage arrangements are carried by the filling tube 6 forming a toggle-type clamp arrangement. Each linkage arrangement is comprised of a pair of links 28 and 29 with the link 28 having one end pivotally mounted on the filling tube 6 as at 30 by a bracket 31 which is secured to the tube 6. The opposite end of the link 28 is pivotally connected to the link 29 as at 32; preferably, the opposite end of the link 29 is pivotally connected to a portion of the means 10 as at 33 for movement therewith as hereinafter described. Operation of the linkage arrangement is described below. As shown, the lengths of the links 28 and 29 are such as to prevent an over-center break which would prevent operation of the linkage arrangement. Movement of the pivot 33 toward the pivot 30 effects movement of the links 28 away from the filling tube 6 for clamping engagment of the links 28 with an interior surface of the container 2 adjacent the hatch 3.

Figure 2:
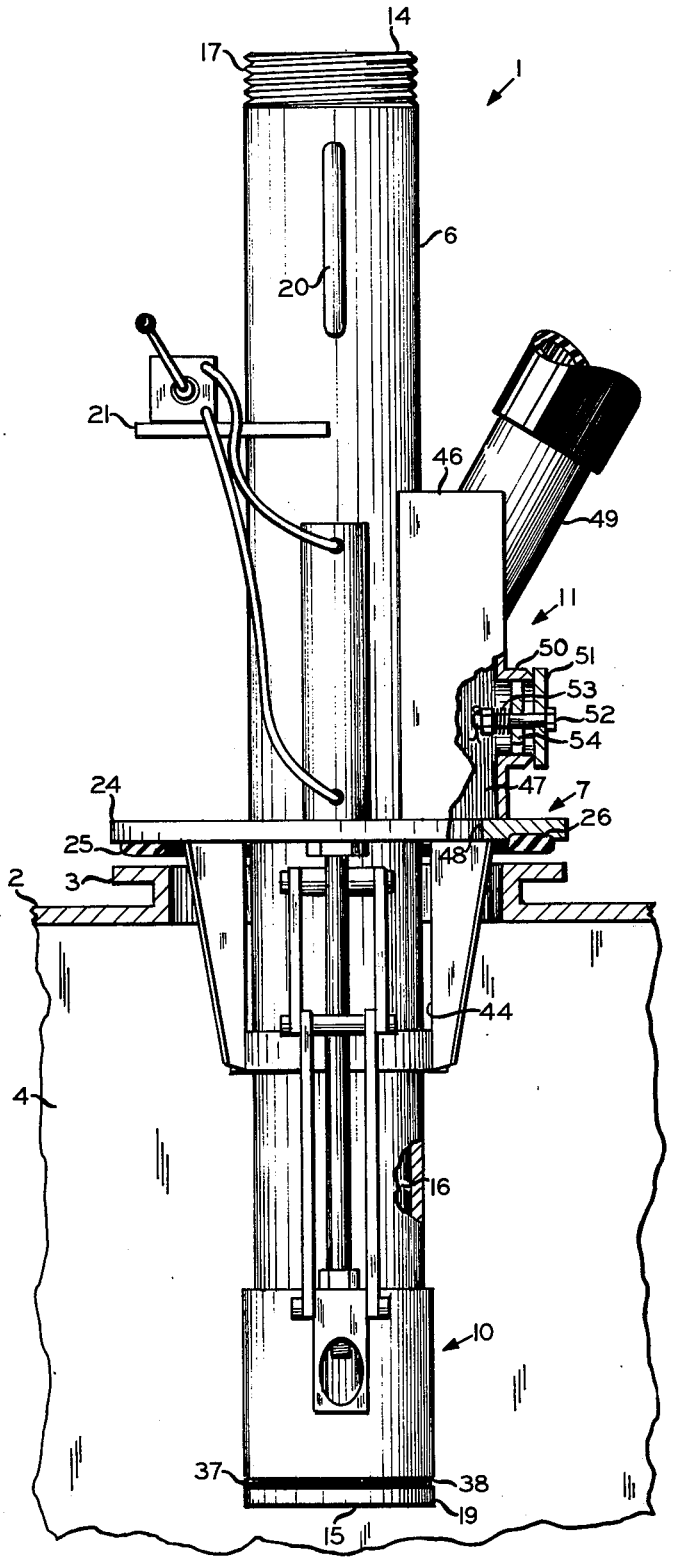
FIG. 2 is a side-elevation view of the dispensing apparatus with portions broken away to show structural details thereof.

The means 10 includes a valve member 35 which is movably mounted on the filling tube 6 and, as shown, is slidable thereon in an axial direction from an aperture open position as best seen in FIG. 1 to an aperture closed position as best seen in FIG. 2. The valve member 35 is sleeved on the filling tube 6 and in the illustrated structure has a pair of ears 36 extending outwardly therefrom to which the links 29 are pivotally connected as at 33. Preferably, the valve member 35 has a height greater than the height of the apertures 9. A seal 37 cooperates with the valve member 35 and the filling tube 6 by being positioned between the flange 19 and a bottom end 38 of the valve member 35 for sealing engagement between same to prevent fluid remaining in the filling tube 6 from leaking out of the apertures 9 when the valve member 35 is in the aperture closed position. Normally, only a small amount of residual liquid remains in the filling tube 6 after the fluid has been dispensed into the container 2 whereby a seal is only required at the bottom edge of the valve member 35. However, it is to be noted that a seal, of the sliding type, can be provided adjacent the upper end of the valve member 35 to positively seal the apertures 9 from the leakage if greater amounts of liquid are retained in the filling tube 6.

Means are provided to effect movement of the valve member 35 and operation of the linkage arrangement and, as shown, the means includes a pair of selectively extendable and retractable rams 40, each mounted on opposite sides of the flange 24 and having rod portions 41 extending downwardly having the free ends thereof suitably secured to the ears 36. Extension and retraction of the rams 40 effects the movement of the valve member 35 and also operation of the linkage arrangements. The rams are connected to a suitable operating source (not shown) such as compressed air to effect operation of the rams 40. The controls 42 for the rams 40 are shown mounted on the bracket 21.

Preferably, a guide 43 is secured to the underside of the flange 19 and is somewhat conically shaped providing a guiding lead-in to effect centering of the apparatus 1 in the hatch 3. As shown, the guide 43 has a pair of cutouts 44 on opposite sides to provide operating room for the linkage arrangements and the rods 41.

The conduit means 11 can be of any suitable type to effect communication between the interior and the exterior of the container 2 when the apparatus 1 is installed for dispensing. As shown, the conduit forming means 11 includes a hollow housing 46 secured to both the filling tube 6 and the flange 24 and provides a flow passage 47 which communicates with the interior of the container 2 and the exterior thereof. An opening 48 is through the flange 24 to complete the communication between the interior and exterior as described above. An exhaust 49 which is adapted to be connected to a recovery system (not shown) as is known in the art communicates with the flow passage 47 to provide an outlet for the flow passage 47. It is preferred that the apparatus 1 have pressure relief means to prevent excessive pressure build-up in the container 2 in the event that the recovery system is not adequate to handle the expelled vapors. As shown, the pressure relief means includes a nipple 50 which communicates with the flow passage 47 and the atmosphere. A seal plate 51 overlies and closes the nipple 50 and is carried by a bolt or guide 52 which is spring-loaded by a spring 53 which is set for a predetermined amount of compression for the desired relief pressure. The guide 52 is carried by a perforate spider 54 which is secured in the interior of the nipple 50. One or more of the above described pressure reliefs can be provided for the apparatus 1.

The above described apparatus is more clearly understood by a description of the operation thereof. When it is desired to fill a container 2 with a liquid, the cover (not shown) for the hatch 3 is removed therefrom and the apparatus 1 is inserted into the hatch opening wherein the lower end 15 of the filling tube 6 is in the interior of the container 2. The apparatus 1 is positioned so that the flange 24 overlies and closes the hatch opening and the seal 25 is in engagement with the hatch 3. Retraction of the rams 40 moves the valve member 35 upwardly to an aperture open position, as seen in FIG. 1, whereby fluid can be dispensed through the apertures 9 and into the interior 4. Upward movement of the valve member 35 also effects operation of the linkage arranements whereby the links 28 move outwardly pivoting about the pivots 30 with the links 28 moving into engagement with a portion of the hatch 3 to firmly clamp the seal 25 in engagement with the hatch 3 to effect the seal therebetween and prevent escape of vapors except through the flow passage 47. Upon filling of the container 2, the rams are extended moving the valve member 35 downwardly with the lower end 38 sealingly engaging the seal 37 which forms a seal between the valve member 35 and the filling tube 6 to prevent leakage of fluid from the filling tube 6 upon withdrawal of the apparatus 1 from the container 2.

It is to be understood that while I have illustrated and described certain forms of my invention, it is not to be limited to the specific form or arrangement of parts herein described and shown.

What is desired to be secured by letters patent is:

1. An apparatus for dispensing of liquids through an opening of a container, said apparatus comprising:

a. a tubular member having first and second ends, said second end being closed and having an aperture through a side wall of said tubular member;

b. a valve member slidably mounted on the exterior of a portion of said tubular member and axially movable thereon between a first position opening said aperture and a second position closing said aperture, said tubular member portion and valve member being adapted to be received in a container for use;

c. a linkage arrangement carried by said tubular member and pivotally connected to said valve member for pivotal movement relative thereto;

d. first means carried by said tubular member and operably connected to said linkage arrangement and said valve member to selectively effect pivoting movement of said linkage arrangement relative to said valve member and movement of said valve member axially on said tubular member between said first and second positions, wherein movement of said linkage arrangement effects engagement between a portion of same and a portion of a container adjacent an opening therein when said valve member is in the first position; and e. first seal means mounted on said tubular member and adapted to sealingly engage a portion of said container adjacent said opening when said link arrangement portion is in engagement with a portion of said container.

2. The apparatus as set forth in claim 2 including:

a. second seal means positioned between and cooperating with a portion of said valve member and a portion of said tubular member and operable to provide a seal between said valve member and said tubular member when said valve member is in said second position.

3. The apparatus as set forth in claim 2 wherein:

a. said apparatus includes a plurality of said linkage arrangements with each linkage arrangement including a pair of links with one link having an end pivotally connected to said tubular member and the other link having one end pivotally connected to said valve member, said one link and respective other link having the other ends thereof pivotally connected to one another; and b. said first seal means includes a flange secured to said tubular member and extends radially therefrom and includes a seal mounted on said flange and adapted to engage a portion of said container.

4. The apparatus as set forth in claim 3 wherein said first means includes:

a plurality of power means mounted on said flange and each has a movable portion connected to said valve member for effecting movement thereof and said link arrangement.

5. The apparatus as set forth in claim 2 including;

a. second means carried by said tubular member and forming a vent flow passage for communication between the interior and exterior of said container when said first seal means is in sealing engagement with said container for allowing recovery of expelled vapor.

6. The apparatus as set forth in claim 5 including:

a. pressure relief means operatively associated with said second means.

7. An apparatus for dispensing of liquids through an opening of a container or the like with the apparatus sealing the opening and thereby allowing recovery of expelled vapor, said apparatus comprising:

a. a tubular member having first and second ends and a side wall, said second end being closed, at least one aperture is through said side wall adjacent said second end;

b. a tubular valve member slidably mounted on the exterior of a portion of said tubular member and is axially movable thereon between an aperture open first position and an aperture closed second position, said tubular member portion and valve member being adapted to be received in a container for use;

c. a first seal positioned between and cooperating with a portion of said valve member and a portion of said tubular member and operable to provide a seal between said valve member and said tubular member when said valve member is in said second position;

d. a flange secured to said tubular member and extending radially outwardly therefrom;

e. a second seal carried by said flange adapted for sealing engagement with a portion of a container adjacent an opening therein;

f. vent means carried by said tubular member and forming a vent flow passage for communication between the interior and exterior of said container when said second seal is in sealing engagement with said container;

g. a plurality of linkage arrangements each including a first and second link with the first links each being pivotally connected to a respective said second link and to said tubular member at a position between said flange and said valve member, said second links each being pivotally connected to said valve member; and h. power means carried by said tubular member and operably connected to said valve member for moving same axially along said tubular member between the aperture open first position and the aperture closed second position and effecting pivoting movement of said first and second links whereby when said valve member is in said aperture open first position, said first links engage a portion of the container adjacent the opening therein for urging said second seal into sealing engagement with the container portion.

* * * * *